US008857335B2

(12) United States Patent
Böhm et al.

(10) Patent No.: US 8,857,335 B2
(45) Date of Patent: Oct. 14, 2014

(54) METHOD FOR CHANGING PRINTING PLATES

(75) Inventors: Rüdiger Böhm, Wörth-Maximiliansau (DE); Martin Greive, Schriesheim (DE); Jochen Körner, Viernheim (DE); Dirk Schönmann, Schifferstadt (DE); Michael Zellner, Östringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 140 days.

(21) Appl. No.: 13/593,885

(22) Filed: Aug. 24, 2012

(65) Prior Publication Data

US 2013/0192485 A1 Aug. 1, 2013

(30) Foreign Application Priority Data

Aug. 26, 2011 (DE) ..... 10 2011 111 716

(51) Int. Cl.
*B41F 27/12* (2006.01)
*B41F 27/00* (2006.01)

(52) U.S. Cl.
CPC ..... *B41F 27/1206* (2013.01); *B41F 27/12* (2013.01); *B41F 27/00* (2013.01)
USPC ..... 101/477; 101/483

(58) Field of Classification Search
CPC ..... B41F 27/00; B41F 27/1206; B41F 27/12
USPC ..... 101/477, 483
IPC ..... B41F 27/12
See application file for complete search history.

(56) References Cited

U.S. PATENT DOCUMENTS

| | | | | |
|---|---|---|---|---|
| 5,111,744 | A * | 5/1992 | Wieland | 101/216 |
| 5,127,328 | A * | 7/1992 | Wieland | 101/415.1 |
| 5,208,960 | A | 5/1993 | Maejima et al. | |
| 5,255,420 | A | 10/1993 | Maejima et al. | |
| 5,390,603 | A * | 2/1995 | Hauck et al. | 101/485 |
| 5,540,151 | A * | 7/1996 | Ruckmann et al. | 101/477 |
| 5,595,119 | A * | 1/1997 | Hada et al. | 101/477 |
| 2009/0013889 | A1 | 1/2009 | Gorbing et al. | |

FOREIGN PATENT DOCUMENTS

| | | |
|---|---|---|
| DE | 10 2008 030 438 A1 | 1/2009 |
| DE | 10 2008 048 281 A1 | 4/2009 |
| DE | 10 2008 051 581 A1 | 5/2009 |
| EP | 0 435 413 B2 | 5/2002 |

OTHER PUBLICATIONS

German Patent and Trademark Office Search Report, Dated Oct. 26, 2011.

* cited by examiner

*Primary Examiner* — Leslie J Evanisko
(74) *Attorney, Agent, or Firm* — Laurence A. Greenberg; Werner H. Stemer; Ralph E. Locher

(57) ABSTRACT

A method and an apparatus for changing a printing plate on a printing press, include feeding the printing plate to a withdrawal chute of a plate changing apparatus by rotating the plate cylinder backward. Drivable transport rollers grip the printing plate and pull the latter out of a previously opened clamping device for the leading edge of the printing plate during the plate cylinder rotation, without the plate cylinder having to be stopped.

5 Claims, 3 Drawing Sheets

METHOD FOR CHANGING PRINTING PLATES

CROSS-REFERENCE TO RELATED APPLICATION

This application claims the priority, under 35 U.S.C. §119, of German Patent Application DE 10 2011 111 716.8, filed Aug. 26, 2011; the prior application is herewith incorporated by reference in its entirety.

BACKGROUND OF THE INVENTION

Field of the Invention

The invention relates to a method and an apparatus for carrying a printing plate away from a plate cylinder and feeding a new printing plate onto the plate cylinder.

German Patent Application DE 10 2008 051 581 A1 discloses an apparatus for drawing a printing plate away from a plate cylinder, in which a trailing edge of the printing plate released by a clamping device is fed to a pair of transport rollers through the use of a backward rotation of the plate cylinder.

European Patent EP 0 435 413 B2, corresponding to U.S. Pat. Nos. 5,208,960 and 5,255,420, discloses a printing plate changing method in which the printing plates of adjacent printing units having plate cylinders disposed with a phase offset with respect to one another are changed virtually synchronously. In that case, provision is made for all of the plate cylinders to be stopped when a printing plate unclamping position of a plate cylinder is reached, and for that printing plate clamping device for the leading edge of the printing plate which is located in the printing plate unclamping position to be opened.

In a printing press having four printing units, for example, the plate cylinders disposed with a phase offset with respect to one another and connected to one another through the use of a gear train, must be stopped at least four times in order to remove all of the printing plates.

SUMMARY OF THE INVENTION

It is accordingly an object of the invention to provide a method and an apparatus for changing printing plates, which overcome the hereinafore-mentioned disadvantages of the heretofore-known methods and apparatuses of this general type and which minimize printing plate changing time.

With the foregoing and other objects in view there is provided, in accordance with the invention, a method for changing a printing plate, in particular for carrying the printing plate away from a plate cylinder of a printing press. The method comprises initially opening a clamping device for a trailing edge of the printing plate mounted on the plate cylinder while rotating the plate cylinder backward, then opening a clamping device for a leading edge of the printing plate, then gripping the printing plate after passing through driven transport rollers and carrying the printing plate away from the backwardly-rotating plate cylinder by the transport rollers without stopping the plate cylinder, and pushing the printing plate into a withdrawal chute by the backward rotation of the plate cylinder.

It is a particular advantage of the invention that, through the use of the method according to the invention, the changeover times of a printing press can be shortened.

This method is possible, in particular, as a result of the fact that a clamping device for a leading edge of the printing plate is already opened in an angular range in which the plate cylinder has not yet reached an unclamping position for the printing plate. In addition, the printing plate is transported away, through the use of stationary transport rollers disposed outside the plate cylinder, at a speed which is higher than the speed of the plate cylinder rotating backward.

As a result of this measure, the printing plate can even be removed from the plate cylinder while the latter is still moving. Sensors for monitoring the printing plate changing are disposed in guide devices provided for the printing plate. As a result of this measure, stopping the machine in good time in the event of a malfunction is possible.

Other features which are considered as characteristic for the invention are set forth in the appended claims.

Although the invention is illustrated and described herein as embodied in a method and an apparatus for changing printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 is a longitudinal-sectional view showing a printing unit of the sheet-fed rotary printing press as a new printing plate is fed in.

DETAILED DESCRIPTION OF THE INVENTION

Figure 1:
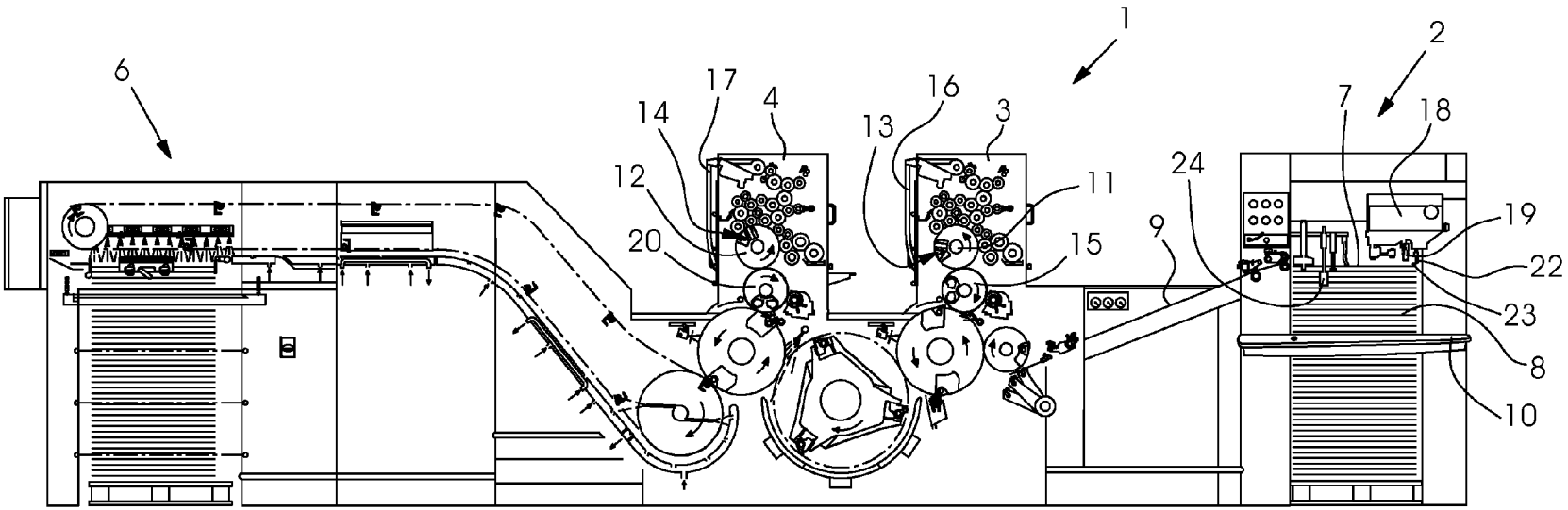
FIG. 1 is a diagrammatic, longitudinal-sectional view of a sheet-fed rotary printing press.

Referring now to the figures of the drawings in detail and first, particularly, to FIG. 1 thereof, there is seen a machine 1 for processing sheets 7, e.g. a printing press, which has a feeder 2, at least one printing unit 3 and 4 and a delivery 6. The sheets 7 are removed from a sheet stack 8 and fed, individually or in overlapping form, over a feed table 9 to the printing units 3 and 4. The latter each contain, in a known way, a plate cylinder 11, 12 and a blanket cylinder 15, 20 respectively interacting therewith. The plate cylinders 11 and 12 each have a clamping and tensioning apparatus 13, 14 for fixing flexible printing plates. Furthermore, each plate cylinder 11, 12 is assigned an apparatus 16, 17 for semiautomatic or fully automatic printing plate changing.

The sheet stack 8 rests on a stack board 10 that can be raised under control. The sheets 7 are removed from the upper side of the sheet stack 8 through the use of a so-called suction head 18 which, inter alia, has a number of lifting and dragging suckers 19 for separating the sheets 7. Furthermore, blowing apparatuses 22 are provided for loosening the upper sheet layers, as are sensing elements 23 for stack tracking. A number of lateral and rear stops 24 are provided in order to align the sheet stack 8, in particular the upper sheet 7 of the sheet stack 8.

Figure 2:
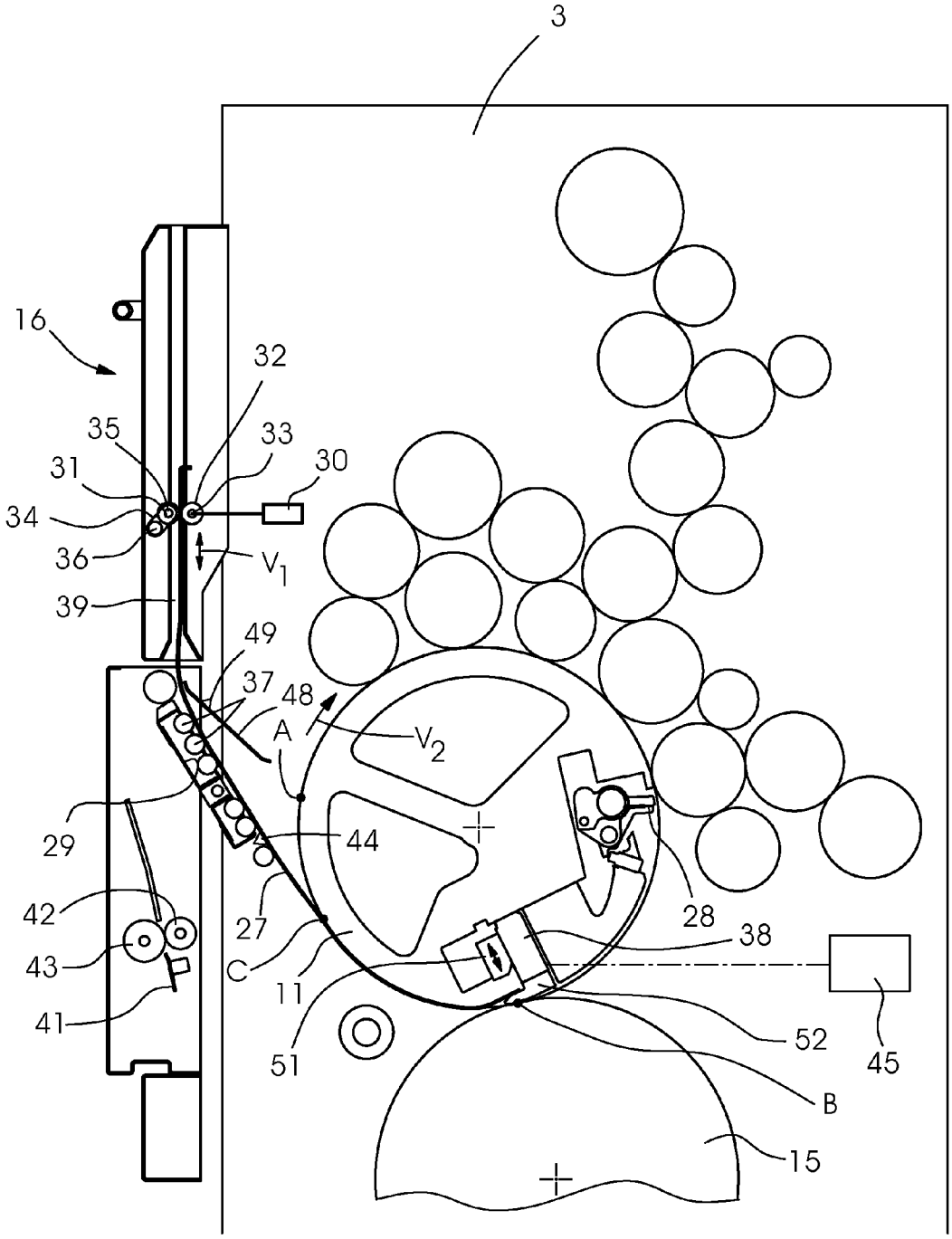
FIG. 2 is a longitudinal-sectional view showing a printing unit of the sheet-fed rotary printing press as a printing plate is carried away.
Figure 3:
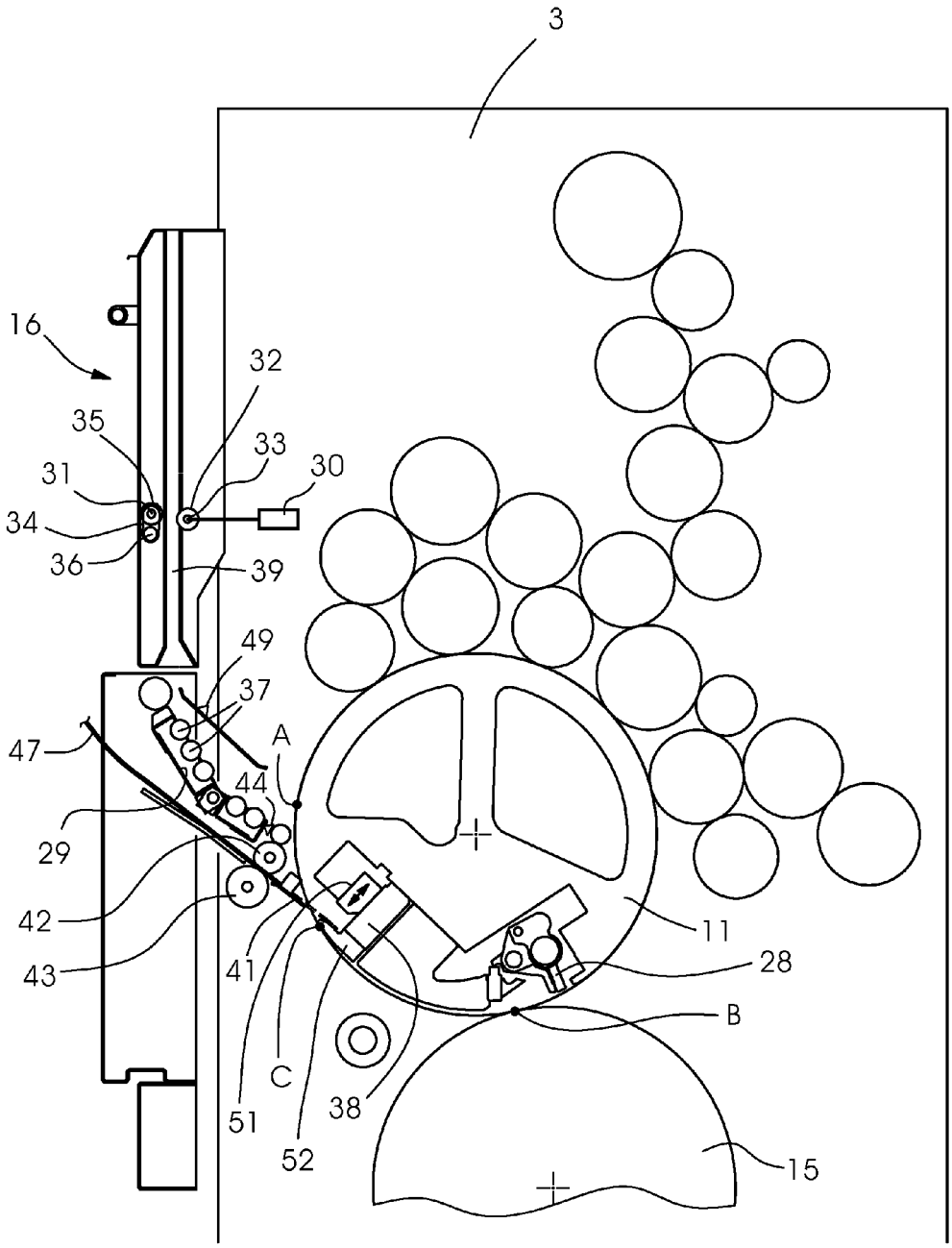

The apparatuses 16, 17, which are used for fixing flexible printing plates 27 shown in FIGS. 2 and 3, are structurally identical and will therefore be described only by using the apparatus 16.

The printing plate changing apparatus 16 is disposed in such a way that it can be moved in front of the printing unit 3 as a guard. The printing plate 27, which is clamped firmly on the plate cylinder 11, is unwound from the plate cylinder 11 by a backward rotation of the latter after opening a clamping device 28, for example a clamping bar for the trailing edge of the printing plate. The printing plate 27 is fed to transport rollers 31, 32 through the use of a pivotably disposed guide element 29. The transport roller 32, which is disposed so as to be stationary, is rotatably mounted and is disposed on a housing of the printing plate changing apparatus 16 in such a way that it can be driven through the use of a drive 30, and has a freewheel 33.

The transport roller 31 is movable, rotatably mounted at the end of a lever 34 and disposed in such a way that it can be pivoted about a bearing point 36 of the printing plate changing apparatus 16. A freewheel 35 permits a rotational movement of the transport roller 31 only in one direction, namely away from the plate cylinder, in order to ensure that the printing plate 27 can be removed by an operator without separating the transport rollers 31, 32.

In the method for changing the printing plate 27 of the printing unit 3, the plate cylinder 11 is firstly rotated backward to such an extent that the trailing edge clamping device 28 reaches a printing plate unclamping position A. This is approximately opposite the guide element 29 which is used to carry the printing plate 27 away. The trailing edge clamping device 28 is opened without stopping the rotation of the plate cylinder, and the end of the printing plate springs out of the clamping device 28 as a result of the inherent tension of the printing plate 27. In this case, the end of the printing plate is deposited on rollers 37 of the guide element 29. As a result of the backward rotation of the plate cylinder 11 counter to the direction of rotation, the printing plate 27 is pushed into a withdrawal chute 39 of the printing plate changer 16 until the printing plate end has passed through the transport rollers 31, 32.

A first sensor 44 disposed on the guide element 29 monitors the presence of the printing plate 27, in particular of the trailing edge of the printing plate on the guide element 29, after the trailing edge clamping device 28 has been opened.

If improper detachment of the trailing edge of the printing plate from the trailing edge clamping device 28 is detected, the plate cylinder 11 stops.

After the printing plate end has reached the transport rollers 31, 32, a clamping device 38 for the leading edge of the printing plate reaches a cylinder gap B between the plate cylinder 11 and the blanket cylinder 15, according to FIG. 2. The leading edge clamping device 38 is now opened under control of a control computer 45 of the printing press 1 as a function of a machine angle. At approximately the same time, the first transport roller 31 is driven by the drive or auxiliary motor 30 and the second transport roller 32 is set against the first transport roller 31, so that the printing plate 27 is gripped and conveyed away from the plate cylinder 11. A circumferential speed $V_1$ of the transport rollers 31, 32 is greater in this case than a circumferential speed V2 of the plate cylinder 11 rotating backward, so that the printing plate 27 is drawn securely out of the leading edge clamping device 38 and away from the plate cylinder 11 without the plate cylinder 11 stopping. A second sensor 49 disposed on an upper guide apparatus 48 monitors the presence of the start of the printing plate and signals the successful detachment of the printing plate 27 from the plate cylinder 11.

This unclamping operation, which has been described by using the plate cylinder 11 of the printing unit 3, is carried out sequentially, depending on the phase offset of the plate cylinders of the remaining printing units 4, and so on.

In order to mount the plate cylinders 11, 12, the printing press, that is to say the plate cylinders 11, 12 having a drive connection thereto, rotate about their direction of rotation and stop in a feed position C for a new printing plate 47. In the feed position C, the leading edge clamping device 38 is positioned opposite a pivotable guide apparatus 41. The guide apparatus 41, with the new printing plate 47 pre-positioned thereon, pivots in the direction of the plate cylinder 11, and transport rolls 42, 43 transport the printing plate 47 into the leading edge clamping device 38. After the printing plate position in the leading edge clamping device 38 has been checked by sensors, the clamping device 38 is closed by moving a radially movable clamping bar 51 in the direction of an upper clamping bar 52.

The printing press 1 and therefore the plate cylinder 11 then rotates further forward until the next plate cylinder 12 of one of the other printing units has reached the appropriate feed position C. The clamping device 38 for the leading edge of the printing plate 27 is opened as the printing plate 27 is carried away from the plate cylinder 11, preferably at a predefined constant machine speed, in a region in which the clamping device 38 is located between the positions B and A.

In this case, provision can additionally be made to ensure that, in the event of an increase in the machine speed during its backward rotation, the opening time of the clamping device 38 within the region (B-A) is displaced forward in the direction of the position B, and in the event of a lower machine speed, is displaced later in the direction A.

Furthermore, when feeding the printing plate in, it is suggested that stopping the plate cylinder 11 in the plate feed position C be dispensed with, by driving the new printing plate 27 by the transport rollers 42, 43 at a higher speed $V_3$ than a circumferential speed $V_4$ of the plate cylinder 11 as the printing plate is fed in.

The invention claimed is:

1. A method for changing a printing plate and carrying the printing plate away from a plate cylinder of a printing press, the method comprising the following steps:

initially opening a clamping device for a trailing edge of the printing plate mounted on the plate cylinder while rotating the plate cylinder backward;

then opening a clamping device for a leading edge of the printing plate without stopping the plate cylinder;

then gripping the printing plate after passing through driven transport rollers and carrying the printing plate away from the backwardly-rotating plate cylinder by the transport rollers without stopping the plate cylinder; and pushing the printing plate into a withdrawal chute by the backward rotation of the plate cylinder.

2. The method according to claim 1, which further comprises driving the transport rollers at a higher circumferential speed than a circumferential speed of the plate cylinder during the backward rotation.

3. The method according to claim 1, which further comprises stopping the plate cylinder in a feed position in order to feed in a new printing plate.

4. The method according to claim 1, which further comprises rotating the plate cylinder forward during feeding in of a new printing plate, while driving the new printing plate with another set of transport rollers at a higher circumferential speed than a circumferential speed of the plate cylinder as the printing plate is fed in.

5. The method according to claim 1, which further comprises sequentially changing printing plates of adjacent printing units with a phase offset.

* * * * *